US005158285A

United States Patent [19]

Flam

[11] Patent Number: 5,158,285

[45] Date of Patent: Oct. 27, 1992

[54] PREFABRICATED RACKET STRING ASSEMBLY

[76] Inventor: Klaus Flam, Kalkstrasse 1, Ratingen, Fed. Rep. of Germany

[21] Appl. No.: 741,744

[22] Filed: Aug. 7, 1991

[30] Foreign Application Priority Data

Aug. 11, 1990 [DE] Fed. Rep. of Germany ..... 9011721

[51] Int. Cl.[5] ..... A63B 51/02

[52] U.S. Cl. ..... 273/73 A; 273/730

[58] Field of Search ..... 273/73 R, 73 A, 73 B, 273/73 C, 73 D, 73 E, 73 L, 29 B; 29/433, 241

[56] References Cited

U.S. PATENT DOCUMENTS

| | | | |
|---|---|---|---|
| 1,733,960 | 10/1929 | Godfrey | 273/730 |
| 4,118,029 | 10/1978 | Septier | 273/73 A X |
| 4,149,722 | 4/1979 | Yager | 273/73 A X |
| 4,456,254 | 6/1984 | McDonald | 273/73 A |
| 4,488,722 | 12/1984 | Harz | 273/730 |
| 4,741,531 | 5/1988 | Szedressy | 273/730 |

FOREIGN PATENT DOCUMENTS

| | | | |
|---|---|---|---|
| 8813991 | 11/1988 | Fed. Rep. of Germany . | |
| 2598323 | 11/1987 | France | 273/730 |
| 9005002 | 5/1990 | World Int. Prop. O. | 273/730 |

*Primary Examiner*—Paul E. Shapiro
*Assistant Examiner*—William E. Stoll
*Attorney, Agent, or Firm*—Chilton, Alix & Van Kirk

[57] ABSTRACT

A prefabricated string assembly for use in the stringing of tennis rackets or the like consists of individual transverse and longitudinal strings crossed with one another in the manner of a fabric weave to form a network having outwardly projecting free string ends for fastening to a racket frame. The transverse and longitudinal strings are arranged such that the strings extending in a first direction have a denser setting than those extending in the transverse direction whereby a collecting zone for the more tightly woven strings is formed over a portion of the length of the strings with the wider setting. The collecting zone is closed on at least one side by a removable holder which engages and thus immobilizes the strings which have the denser setting.

18 Claims, 3 Drawing Sheets

PREFABRICATED RACKET STRING ASSEMBLY

BACKGROUND OF THE INVENTION

1. Field of the Invention

The present invention relates to the stringing of rackets employed in various sports and particularly to facilitating the restringing of tennis rackets or the like. More specifically, this invention is directed to prefabricated string assemblies and especially to a preformed knit of longitudinal and transverse strings which may be quickly and easily installed in a racket frame. Accordingly, the general objects of the present invention are to provide novel and improved methods and apparatus of such character.

2. Description of the Prior Art

Prefabricated string assemblies which define a knit comprised of individual transverse and longitudinal strings are known in the art. An example of such a previously known prefabricated string assembly may be seen from German Patent Publication No. 88 13 991. In the prior prefabricated string assemblies, a stringing pattern was fixed by means of an aligning device which retained the crossed transverse and longitudinal strings in predetermined positions relative to one another. In order to restring a tennis racket or the like, such a prefabricated knit in theory needs merely to be placed in the racket head and the free end of the strings fastened in the appropriate holes provided therefore in the racket frame.

A stringing operation employing a prefabricated string assembly is, when compared to the technique of weaving in a plurality of individual string strands, a relatively simple procedure. However, the use of individual free strings does have the advantage of allowing the technician to select different stringing profiles. Further, prefabricated knits with a fixed stringing pattern have, in practice, not proven to be sufficiently adaptable to permit the fitting thereof to the characteristics of various racket heads, and particularly to accommodate variations in the arrangement of string receiving holes as found in different frames. Furthermore, the packages for prior prefabricated racket string assemblies have necessarily been generally commensurate in size with the head of the racket type for which the assemblies were intended and the packages have thus been characterized by volumetric inefficiency. The above-discussed and other deficiencies have tended to discourage the use of prefabricated racket string assemblies.

SUMMARY OF THE INVENTION

The present invention overcomes the above-briefly-discussed and other deficiencies and disadvantages of the prior art and, in so doing, provides a prefabricated string assembly which is adaptable to the desired end use and which facilitates and expedites the stringing of a sports racket. A string assembly in accordance with the invention is comprised of crossed strings which which are arranged parallelly in two groups and, typically, transversely between groups. The strings of one group, i.e., either the longitudinal or transverse strings, have a different "setting" when compared to the strings of the other group. As used herein, the term "setting" will be understood to mean the distribution per unit of length in the transverse direction of parallel strings. A prefabricated string assembly in accordance with the invention is further characterized by a "collecting zone" where the crossed strings of the two groups are brought together in accordance with the selected tying mode. By reducing the spacing between individual adjacent strings of one string group in relation to the spacing between individual strings of the other string group, more strings of the one string group than of the other string group are distributed over the area of the collecting zone. Since only a particular number of longitudinal and transverse strings, dependent on an intended stringing pattern, are combined with one another for a stringing operation, a prefabricated string assembly in accordance with the invention is characterized by tightly woven strings, i.e., the strings having the closer or denser setting, being distributed only on a portion of the length of the strings which have the wider setting. Thus, the tightly woven strings, in effect, form a "magazine" which supplies strings for the desired final string pattern.

In a prefabricated string assembly in accordance with the invention, the "setting" of the strings of the group which has the wider setting ratio may be determined by the desired racket stringing pattern The "setting" of the strings of the other group will, as noted, be closer whereby a stock of strings, which have already been inserted in the net, will be provided. When the prefabricated string assembly of the invention is used, the necessary and desired mutual spacing of the strings which are packaged with the closer setting will be established after the prefabricated assembly has bee inserted into the racket head. The string assembly in accordance with the invention will, of course, comprise a compressed net of longitudinal and transverse strings, each in sufficient number to accomplish the desired stringing operation. Such a prefabricated string assembly has a more stable design as a net insert when compared to the prior art in that there is little danger that the prelaid, crossed string arrangement will come apart. Also, the prefabricated string assembly of the present invention is obviously more amenable to volumetric efficient packaging.

In the practice of the invention, and continuing to consider an arrangement wherein the strings of the two groups are transversely oriented, it should be obvious that either the longitudinally or laterally extending strings can be arranged with the denser setting. The strings with the closer or denser setting can be as close to an abutting relationship as the weave of the string pattern will permit or these strings can be spaced apart by a slight distance. The collecting zone may be delimited, on at least one side, by a removable holder. In one embodiment of the invention, a holder in the form of a pull-off adhesive foil is employed to define the collecting zone. In another embodiment, individual holders which effectively define a frame are employed; and these individual holders may be in engagement with one another at the corners of a collecting zone.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENTS

Figure 2:
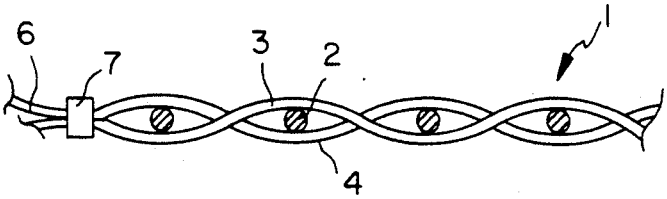
FIG. 2 is a side elevation view taken along line I of FIG. 1.
Figure 1:
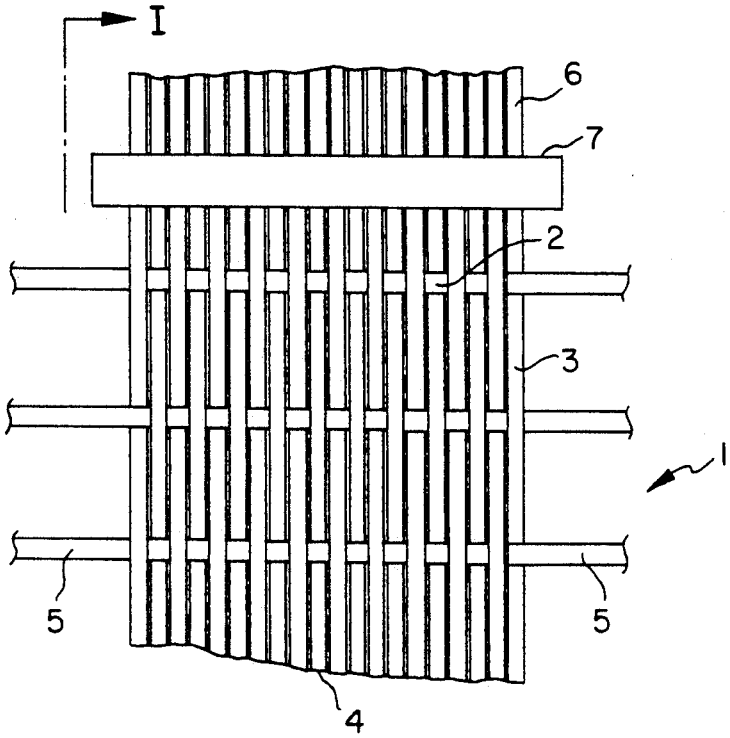
FIG. 1 is a partial top view of a prefabricated string assembly in accordance with a first embodiment of the invention.

With reference now to FIGS. 1 and 2, a first embodiment of a sheet-like prefabricated string assembly, indicated generally at 1, is comprised of a first group of individual longitudinal strings 2 and a second group of transversely oriented strings 3. The prefabricated string assembly 1 is intended for use in the stringing of rackets for tennis, badminton or the like. The longitudinal strings 2 and the transverse strings 3 are crossed with one another in the manner of the warp and weft of a fabric in a linen weave in the disclosed embodiment but can obviously be arranged in another weave. There are more transverse strings 3 than longitudinal strings 2 distributed per unit area in a region 4 of the assembly which will hereinafter be referred to as the collecting zone. Restated, the settings of the longitudinal strings 2 and transverse strings 3 are different and, in the embodiment of FIGS. 1 and 2, the densely set transverse strings 3 are superimposed upon the less densely set longitudinal strings 2 in collecting zone 4.

In the preferred manner of practice of the invention, all of the strings with the denser setting, the transverse strings 3 in the embodiment of FIGS. 1 and 2, extend through the collecting zone 4. Obviously, the ends of the strings 2 and 3 extend beyond the collecting zone 4 a sufficient distance so that the projecting string ends 5, 6 will be of such length as to enable the stringing of rackets of various sizes. The wider setting, i.e., the spacing between the longitudinal strings 2 in the disclosed embodiment, is preferably selected in accordance with an intended stringing pattern. Accordingly, when the prefabricated string assembly 1 is used to string a racket, the projecting string ends 5 will initially be generally in alignment with the string-receiving holes in the racket head. The strings with the denser setting, the transverse strings 3 in the embodiment of FIGS. 1 and 2, will form a tightly woven stock of strings which, while correctly oriented relative to the longitudinal strings 2, will be spaced closer than required for the stringing pattern which is to be obtained. The strings 3 will thus have to be spread out during the racket stringing procedure.

Figure 6:
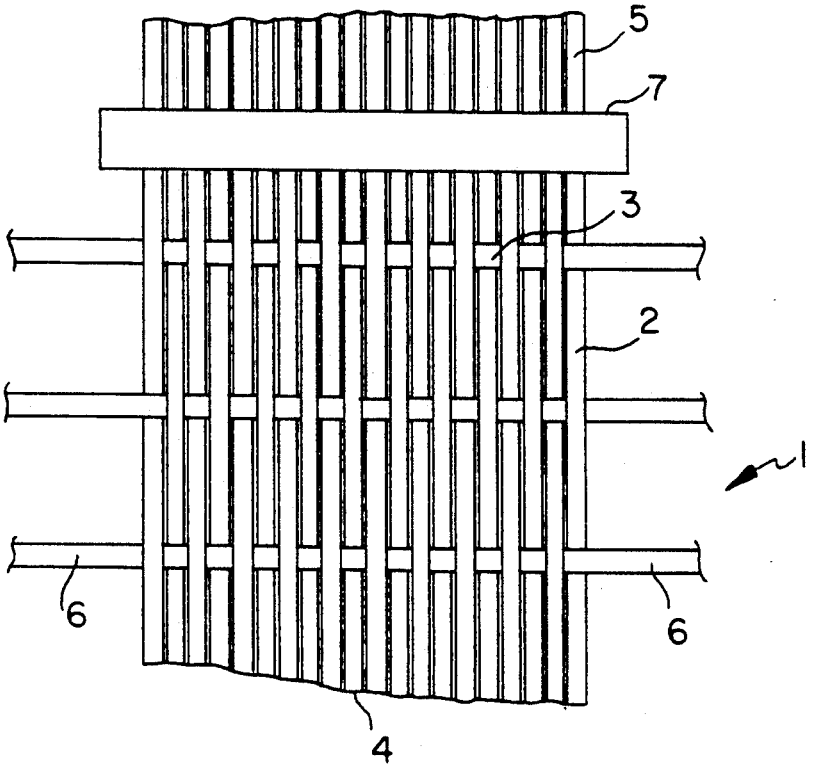
FIG. 6 is a partial top plan view of a fourth embodiment of a prefabricated string assembly in accordance with the invention.

The above statements are, of course, applicable to a prefabricated string assembly wherein the longitudinally extending strings have a dense setting and the transverse strings have a "wide" setting commensurate with the desired end use. Such an arrangement is, in fact, shown in FIG. 6.

As noted above, a region of the prefabricated string assembly defines a collecting zone for the strings of a first group, i.e., longitudinal or transverse in the disclosed embodiments, relative to the strings of the other group. The strings of the first group are, in this collecting zone, pushed closely adjacent to one another. The strings of the other group extend at a mutual spacing which may be defined by the intended end use. Obviously, packaging efficiency will be enhanced by arranging the strings which have the denser setting with the smallest obtainable spacing therebetween. The collecting zone 4 can extend over either a central or an edge region of the matrix of the strings with the wider setting, i.e., the location of the collecting zone 4 is not restricted to an intermediate portion of the group of strings which have the wider setting.

The number of strings inserted into the string assembly 1 obviously depends on a particular or desired stringing pattern, i.e., the intended end use of the assembly. Restated, the number of strings comprising each of the two string groups will typically be selected as a function of the number of strings required for the racket which is to be strung. However, in accordance with a preferred embodiment, one or both groups of string can include a number of strings, for example one to four strings, in excess of the number required for a given stringing pattern. The presence of these extra strings makes it possible to adapt a prefabricated string assembly in accordance with the present invention to a plurality of different stringing patterns.

In the embodiment of FIGS. 1 and 2, the collecting zone or region 4 is limited on at least one side by a holder 7. The strings which have the denser setting are immobilized by means of the holder 7. The holder 7 is formed by lateral closing elements which surround the free ends 6 of the densely laid strings, i.e., the transverse strings 3 in the embodiment of FIGS. 1 and 2 and the longitudinal strings 2 in embodiment of FIG. 6.

Figure 3:
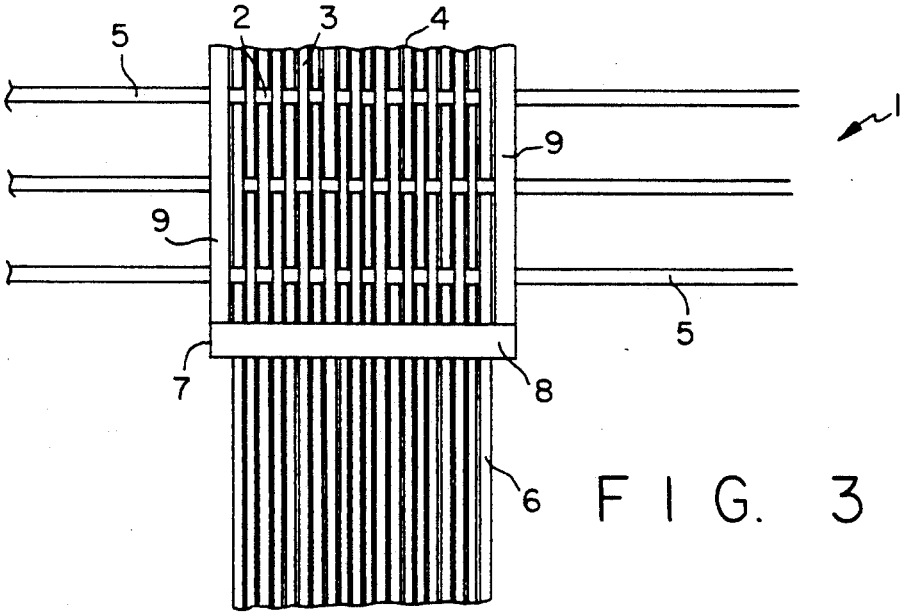
FIG. 3 is a partial top plan view of a second embodiment of a prefabricated string assembly in accordance with the invention.

FIG. 3 depicts a second embodiment of the invention which differs from the embodiment of FIGS. 1 and 2 in the design of the holder 7. The holder of the FIG. 3 embodiment is in the nature of a frame which delimits the collecting zone 4. Thus, the holder 7 of the FIG. 3 embodiment comprises first frame portions 8, which engage the transverse strings 3, and second frame portions 9, which engage the longitudinal strings 2. The frame portions 8 and 9 may interlock with one another where they meet at the corners of the collection zone 4.

Figure 4:
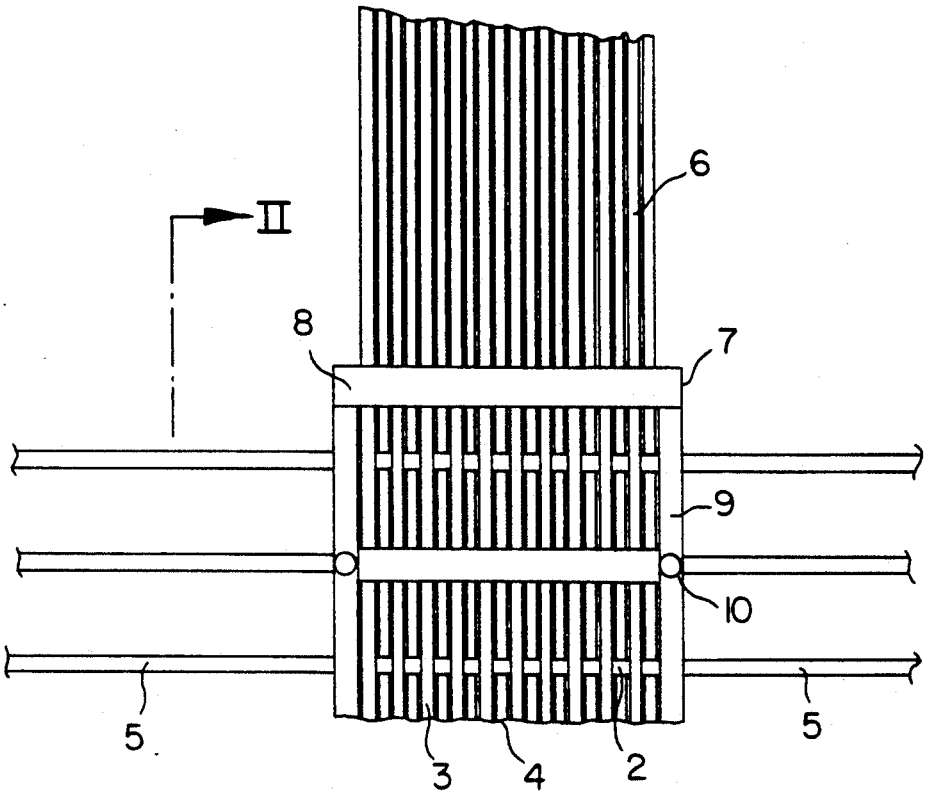
FIG. 4 is a partial top plan view of a third embodiment of a prefabricated string assembly in accordance with the invention.
Figure 5:
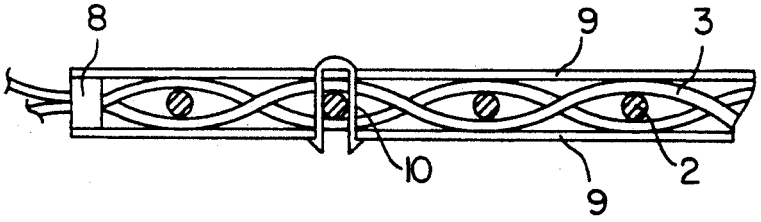
FIG. 5 is a side elevation view taken along line II of FIG. 4.

Referring to FIGS. 4 and 5, a modified version of the assembly I of FIG. 3 is depicted. In FIGS. 4 and 5, the portions 9 of the frame 7, and also the frame portions 8 if deemed necessary or desirable, are defined by upper and lower elements which are releaseably interconnected by means of retention devices 10. The upper and lower elements of the frame portions 9 will be pressed against the frame portions 8 and/or drawn into contact with the longitudinal strings 2 by means of the retention devices 10. As may be seen from FIG. 5, the retention devices 10 can include gripping portions which hook the two element frame portions 9 together.

Figure 7:
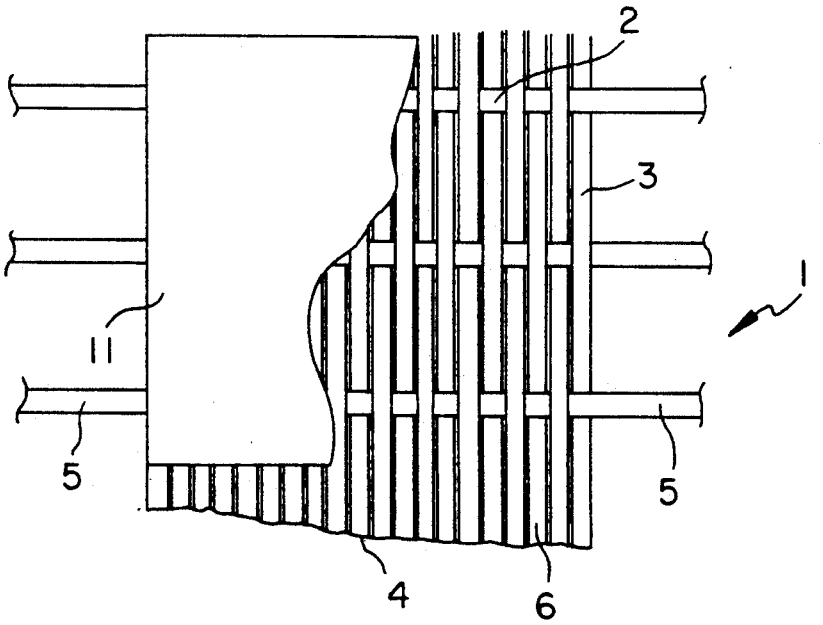
FIG. 7 is a partial top plan view of a fifth embodiment of a prefabricated string assembly in accordance with the invention, FIG. 7 depicting a collection zone defining cover member partially broken away.

In the embodiment of FIG. 7, the holder which delimits the collection zone is in the form of a pull-off adhesive foil 11. Obviously the foil 11 can be applied on one or both sides of the net.

While the present invention has been described in connection with what is presently considered to be the most practical and preferred embodiments, it is to be understood that the invention is not limited to the disclosed embodiments, but rather is intended to cover various modifications and equivalents included within the spirit and scope of the appended claims.

What is claimed is:

1. A prefabricated string assembly for use in the stringing of sports rackets comprising a first plurality of strings, the strings of said first plurality being arranged substantially parallel with one another and extending in a first direction, said assembly further comprising a second plurality of strings, the strings of said second plurality being oriented generally parallel with respect to one another and extending in a second direction, the strings of said first and second pluralities being crossed with one another in the manner of a weave to form a network, the strings of said first and second pluralities having projecting free ends for individual fastening to a frame, the strings of said first plurality having a closer spacing when compared to the strings of said second plurality whereby a tightly woven collecting zone of strings of said first plurality is defined in a region disposed along a portion of the length of the strings of said second plurality, and removable holder means for at least in part delimiting said collecting zone, said holder means retaining the spacing between said strings of said first plurality.

2. The prefabricated string assembly of claim 1 wherein the strings of said first plurality are positioned adjacent to one another to define a dense setting, and the strings of said second plurality are spaced apart to define a wide setting.

3. The string assembly of claim 2 wherein said strings of said first and second pluralities are oriented substantially perpendicular with respect to each other and the strings having the dense setting extend in the longitudinal direction.

4. The string assembly of claim 2 wherein said strings of said first and second pluralities are oriented substantially perpendicular with respect to each other and the strings having the dense setting extend in the lateral direction.

5. The string assembly of claim 2 wherein the spacing of the strings of said second plurality is defined by a desired racket stringing pattern.

6. The string assembly of claim 1 wherein said holder means comprises an adhesively-coated member.

7. The string assembly of claim 6 wherein said adhesively-coated member covers substantially the entire collecting zone.

8. The string assembly of claim 1 wherein said holder means defines a frame which extends about said collecting zone.

9. The string assembly of claim 1 wherein said holder means comprises upper and lower members and attachment means for engaging said upper and lower members to urge the said members into contact with strings of said assembly.

10. The string assembly of claim 1 wherein said holder means comprises clamping elements which surround the free ends of the strings of at least one of said pluralities of strings along at least a first side of said collecting zone.

11. The string assembly of claim 10 wherein said clamping elements are interconnected to define a frame which encloses said collecting zone.

12. The string assembly of claim 5 wherein said holder means comprises an adhesively-coated member.

13. The string assembly of claim 12 wherein said adhesively-coated member covers substantially the entire collecting zone.

14. The string assembly of claim 5 wherein said holder means defines a frame which extends about said collecting zone.

15. The string assembly of claim 5 wherein said holder means comprises upper and lower members and attachment means for engaging said upper and lower members to urge the said members into contact with strings of said assembly.

16. The string assembly of claim 15 wherein said holder means defines a frame which extends about said collecting zone.

17. The string assembly of claim 5 wherein said holder means comprises clamping elements which surround the free ends of the strings of at least one of said pluralities of strings along at least a first side of said collecting zone.

18. The string assembly of claim 17 wherein said clamping elements are interconnected to define a frame which encloses said collecting zone.

* * * * *